US005140796A

United States Patent [19]

Pope

[11] Patent Number: 5,140,796

[45] Date of Patent: Aug. 25, 1992

[54] CLOSURE TOOL FOR RESEALABLE BAGS

[76] Inventor: William K. Pope, 4354 Waterview Cir., North Charleston, S.C. 29418

[21] Appl. No.: 787,655

[22] Filed: Nov. 4, 1991

[51] Int. Cl.[5] ..... B65B 67/00

[52] U.S. Cl. ..... 53/390; 24/400; 383/64

[58] Field of Search ..... 53/390; 24/400, 401, 24/402; 383/64, 78, 81

[56] References Cited

U.S. PATENT DOCUMENTS

| | | | |
|---|---|---|---|
| 1,809,717 | 6/1931 | Sundback | 24/402 |
| 1,959,318 | 5/1934 | Sundback | 24/400 |
| 3,203,062 | 8/1965 | Ausnit | 24/400 |
| 3,633,642 | 1/1972 | Siegel | 383/64 |
| 3,790,992 | 2/1974 | Herz | 383/64 X |
| 3,806,998 | 4/1974 | Laguerre | 24/400 |
| 4,262,395 | 4/1981 | Kosky | 24/400 |
| 4,460,091 | 7/1984 | Hain et al. | 383/90 X |
| 4,541,117 | 9/1985 | Ashbeck | 383/64 |
| 4,812,056 | 3/1989 | Zieke | 24/587 X |
| 5,020,194 | 6/1991 | Herrington et al. | 24/400 |

*Primary Examiner*—John Sipos
*Assistant Examiner*—Daniel B. Moon
*Attorney, Agent, or Firm*—B. Craig Killough

[57] ABSTRACT

A closure tool for resealable bags incorporating a rib and groove type closure means having generally parallel legs so as to accept a resealable bag between them, are displaced toward each other so as to apply pressure to the rib and groove closure, causing the rib to engage the groove so as to cause a sealing of the resealable bag. One or more slots may be formed in the legs to aid in engaging the rib and groove closure means, and traversing the tool along the rib and groove closure means.

2 Claims, 1 Drawing Sheet

CLOSURE TOOL FOR RESEALABLE BAGS

BACKGROUND OF THE INVENTION

The present invention relates to resealable bags generally, and is more specifically directed to a closure tool which may be used to seal resealable storage bags having rib and groove closure or reseal means.

Plastic bags have long been used as containers and storage means. Commonly, plastic bags are used to contain and store materials, and to protect the contents from the effects of circulating air and the intrusion of moisture.

A common application for such plastic bags is bags which are designated as freezer bags. Food may be placed within the bags, and the bags placed into a freezer. A closure means is provided which seals the contents of the bag from air, including moisture laden air, and liquids. The use of these bags is not limited to the freezer. The bags may be used to store food in the refrigerator, and by properly sealing the bags, moisture and food odors will not invade the contents.

Storage bags have many other uses, and may be used whenever it is desirable to protect the contents from humidity, moisture, or other adverse environmental impact.

For bags of this type to be effective, proper closure means must be provided. Many such means have been employed, including the application of tape to the opening, tie type closures, and other means.

The most successful and effective means of bag closure to date is the use of rib and groove, interlocking closure elements. Two of the most common rib and groove closures are sold under the trademarks Ziploc and Glad Lock. These closure members are actuated generally by engaging the rib within the groove and applying manual pressure along the opposing sides of the rib and groove to seal the container opening. Various bag closures are disclosed in U.S. Pat. Nos. 3,790,992, 4,460,091, and 4,541,117. These rib and groove closure elements require particular attention to insure that proper sealing is obtained along the entire length of the closure means. Failure to completely engage the rib within the groove along the entire length of the closure results in the contents being exposed to environmental effects, including moisture, humidity, food odors and the like. One approach to insuring sealing across the entire length of the rib and groove closure is to create either the rib or the groove in blue, with the opposite element in yellow, so that when the rib and grooves are properly combined, a consistent green color appears. However, such a solution still does not provide a means, other than the use of the fingers, to assist in the engagement of the rib and groove. It is difficult to rely on the rib and groove materials to maintain the constant and adequate pressure necessary to insure complete engagement of the rib within the groove along the entire length of the bag. If alignment becomes distorted anywhere along the length, it is likely that the rib will not properly engage the groove.

SUMMARY OF THE PRESENT INVENTION

The present invention is a tool which may be used to insure complete rib and groove closure. The device aids in alignment of the rib and groove material to achieve complete and proper engagement of the rib and groove.

The closure tool is a clip-like device having two generally parallel legs joined at one end. A container having a rib and groove type closure means is inserted between the legs, and the legs are displaced toward each other so as to apply pressure on the rib and groove closure. With manual pressure applied to each of the legs so as to displace them, the user causes the tool to traverse the length of the rib and groove closure so as to apply pressure to the closure so as to seal the bag. The device may have one or more grooves of various widths which aid in guiding the tool holder along the length of the closure, and the device may have position marks to allow alignment of the device. Skirts may be provided as extensions to one or both legs to facilitate movement of the device along the closure.

DETAILED DESCRIPTION OF THE DRAWINGS

DETAILED DESCRIPTION OF THE PREFERRED EMBODIMENT

The present invention is a tool which may be used to close rib and groove interlocking closure elements. Closure means of this type are typically found on flexible film containers, and more particularly, are used as closure means on plastic bags.

Figure 2:
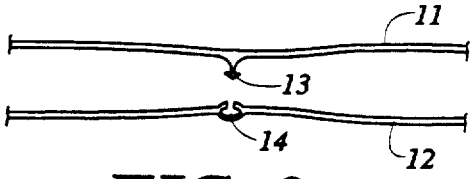
FIG. 2 is a sectioned view illustrating the rib and groove type closure.
Figure 3:
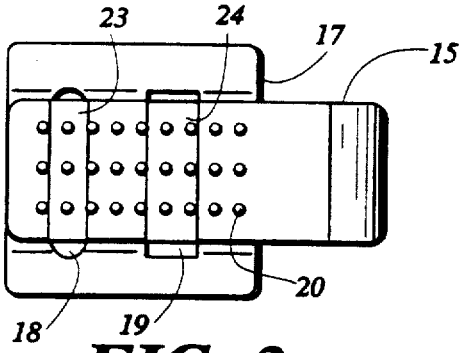
FIG. 3 is a top, plan view of the closure tool.
Figure 4:
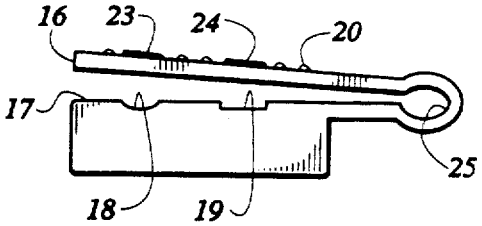
FIG. 4 is a side elevation of the closure tool.
Figure 5:
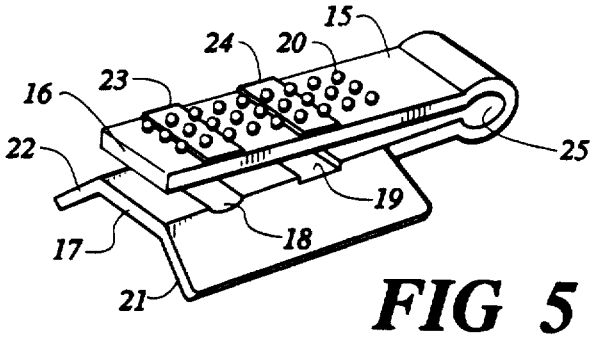
FIG. 5 is a perspective view of the closure tool.

FIG. 2 demonstrates the relationship between the rib element and the groove element. The flexible film container, or plastic bag 10, is typically made of two pieces of plastic film 11, 12 which are permanently sealed about three sides thereof to form a pocket. The fourth side is open to allow materials to be placed within, or removed from, the container. These film panels are generally parallel to each other. The rib 13 is formed in one panel, and is adjacent to and corresponds with the groove 14 which is formed in the opposite panel. The male rib 13 engages the female groove 14 of the opposite panel so as to be held in place by the female groove. The female groove is rigid enough to hold the rib in place within the groove when no pressure is applied, or when minimal, predetermined pressure is applied, but it is sufficiently resilient to allow the male rib to be disengaged when sufficient manual force is applied so as to allow an opening of the container.

The closure tool comprises a pair of legs 16, 17 which are substantially parallel to each other, and which are displaced from each other to allow the container incorporating a rib and groove closure to be inserted between the legs.

An opening is provided between the legs 16, 17 to allow insertion of the container, with the legs connected on the opposite ends of the legs by hinging means 25. The hinging means 25 allows the legs to be substantially parallel to each other and displaced from each other when no pressure is applied to the legs, but allows for displacement of the legs toward each other to apply pressure to the rib and groove closure means so as to seal the closure means. In the preferred embodiment, the tool is fabricated in one piece from a material which is flexible at the point of joinder of the legs to allow the legs to be displaced to apply pressure on the closure, but which has sufficient shape retention properties to cause the legs to resume their original position when no pressure is applied.

Figure 1:
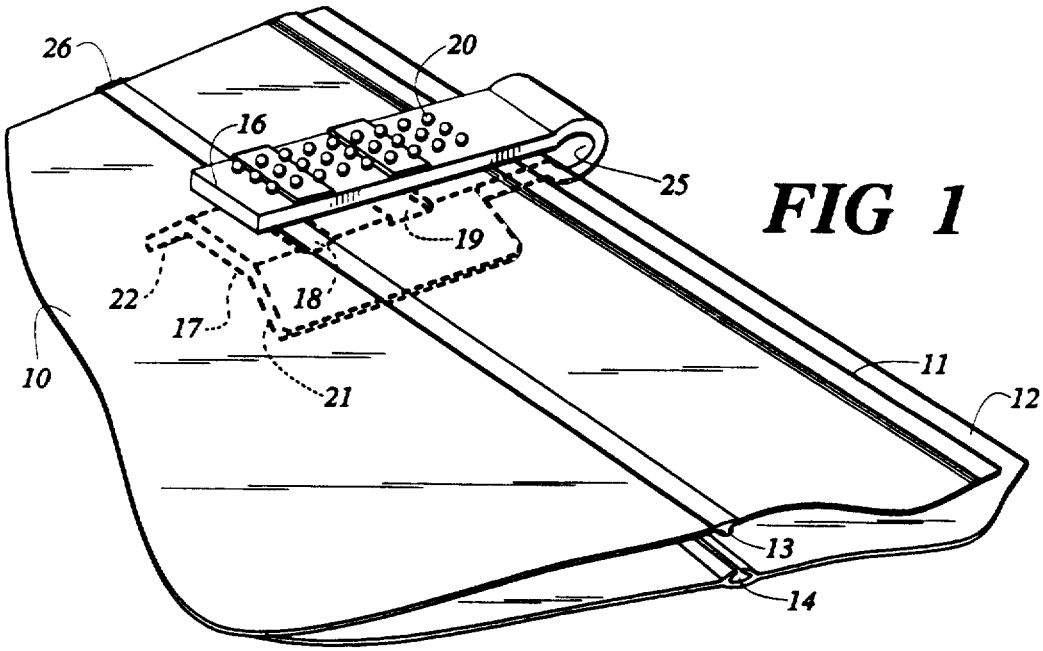
FIG. 1 is a partial view of the closure tool engaging the rib and groove closure of a container.

One or more slots 18, 19 are formed on the interior surface of one of the legs 17. A Slot 18 is of a dimension which will allow the device to engage the exterior portion of the rib and groove closure. Accordingly, the device is placed over the bag as shown in FIG. 1, with the groove engaging the exterior portion of the rib and groove closure. One or more additional slots may be provided in the device for rib and groove closure means having different rib dimensions. For example, the groove of the rib and groove closure may be wider than the rib. Accordingly, a slot of one width may be provided for engagement with the groove, and a slot of a different width provided for engagement with the rib.

The closure tool is placed over the bag with the bag between the legs as shown in FIG. 1, with the slot engaging the rib, and pressure is applied to the legs of the closure tool so as to displace the legs toward each other. Sufficient pressure is applied to the legs to cause the rib to engage the groove.

The device is then pushed or pulled so as to cause the device to traverse the length of the rib and groove closure, while pressure is maintained to displace the legs so as to cause the rib and groove to engage along the entire length of the closure. The somewhat slick surface of the plastic bag facilitates movement of the device along the length of the closure means while pressure is applied to the legs.

After the device has traversed the length of the closure, manual pressure is released from the legs and the legs regain their original position so as to be displaced from each other. The plastic bag is now sealed by means of the engagement of the rib and groove closure along the entire length of the closure.

Movement of the device along the length of the bag is facilitated by wings 21, 22 extending from one of the legs. In the preferred embodiment, the wings extend from the leg in which one or more grooves are formed Gripping means 20 may also be provided, particularly on the leg opposite the leg comprising the wings, to facilitate the application of pressure and the movement of the tool along the length of the closure. The gripping means could be dimples formed in the leg, or a series of peaks and valleys, or a series of grooves formed within the leg.

To aid in aligning the device, color coding bar means 23, 24 may be placed on one or both of the legs over the slots to aid in alignment and engagement of the proper slot with the rib. The color coding means may be of the same width as the slots formed within the device.

Most commonly, the device will be used by placing the device over the bag as shown in FIG. 1 so as to engage the selected slot with the top surface 26 of the rib. The thumb will be placed over the top of the device when shown in the position of FIG. 1 with the index finger placed under the device so as to contact the wings to facilitate movement of the device along the length of the closure.

What is claimed is:

1. A closure tool for sealing resealable containers having rib and groove interlocking closure means, said tool comprising:

a. a first leg having a flat, planar interior surface;

b. a resilient hinge means to which said first leg is attached at an end of said first leg; and c. a second leg having a flat, planar interior surface which is attached to said resilient hinge means at an end of said second leg, wherein said first leg and said second leg extend from said hinge means in the same direction, and wherein said first leg and said second leg are slightly divergent from each other as said first leg and said second leg extend from said hinge means toward a free end of said first leg and a free end of said second leg, so as to form an opening between said first leg and said second leg, wherein said resilient hinge means allows said first leg and said second leg to be displaced toward each other to allow pressure to be applied to said rib and groove closure means and wherein at least one linear slot is formed across the whole width of said flat, planar interior surface of said second leg between said end which is attached to said hinge means and said free end to accommodate and slide along said rib and groove closure means.

2. A closure tool for sealing resealable containers having rib and groove interlocking closure means as described in claim 1, further comprising a color coding means having at least one bar of contrasting color placed on an exterior surface of at least one of said first leg or said second leg which is parallel to and corresponds to said at least one slot to allow a location of said at least one slot on said second leg to be identified so as to facilitate engagement of said at least one slot with said rib and groove closure means.

* * * * *